US006295004B1

(12) United States Patent
Burnett

(10) Patent No.: US 6,295,004 B1
(45) Date of Patent: Sep. 25, 2001

(54) APPLIANCE WARNING LIGHT DEVICE

(76) Inventor: S. Mark Burnett, 1545 Mound St., Sarasota, FL (US) 34236

( * ) Notice: Subject to any disclaimer, the term of this patent is extended or adjusted under 35 U.S.C. 154(b) by 0 days.

(21) Appl. No.: 09/732,073

(22) Filed: Dec. 7, 2000

(51) Int. Cl.[7] ..... G08B 21/00

(52) U.S. Cl. ..... 340/686.1; 340/689; 340/545.6; 340/546; 134/113

(58) Field of Search ..... 340/686.1, 689, 340/545.1, 546, 545.5, 545.6, 429, 908.1, 982, 983; 200/621.45 R, 621.52; 134/113

(56) References Cited

U.S. PATENT DOCUMENTS 4,765,697 * 8/1988 Gardell et al. ..... 312/229
4,894,643 1/1990 Thompson et al. .
5,151,884 * 9/1992 Griffith et al. ..... 368/10
5,365,959 * 11/1994 Favaro ..... 134/113
5,479,152 * 12/1995 Walker et al. ..... 340/545
5,856,781 * 1/1999 Michel et al. ..... 340/547
6,023,887 * 2/2000 Okubo ..... 49/13

* cited by examiner

*Primary Examiner*—Jeffrey Hofsass
*Assistant Examiner*—Daniel Previl
(74) *Attorney, Agent, or Firm*—Charles J. Prescott

(57) ABSTRACT

A warning light device attachable to, or as a permanent part of, a front door of an automatic dishwasher or oven, the front door being openable to a generally horizontal very low position above the floor. In one embodiment, the device includes a housing attachable to a surface of the front door. A warning light mounted on the housing receives electric power from a miniature storage battery mounted within the housing. An angle-sensitive switch mounted in the housing is operably interconnected between the warning light and the storage battery. The switch is open and the warning light off when the front door is closed, while the switch is closed and the warning light on when the front door is open. The warning light, when on, is sufficiently visible to warn or alert a person nearby the dishwasher that the front door is open and to be avoided. This invention may also be embodied in such appliances at time of manufacture.

8 Claims, 4 Drawing Sheets

FIG. 7
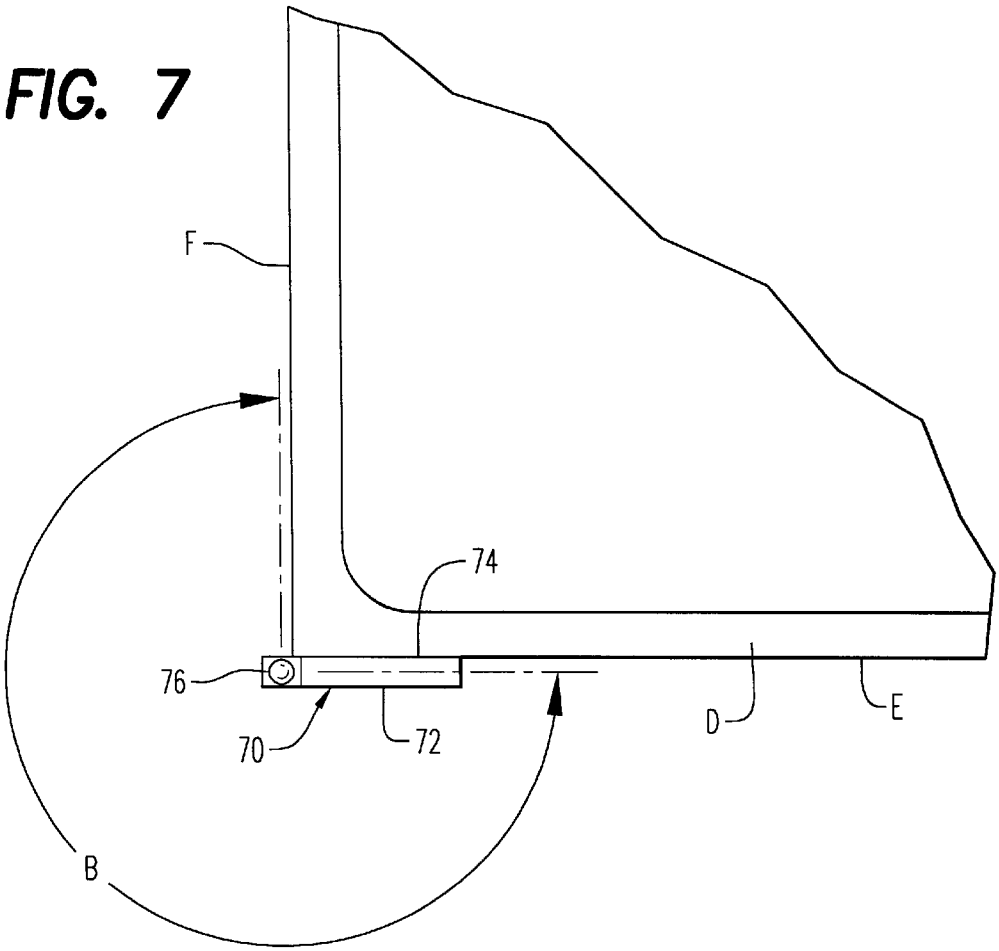
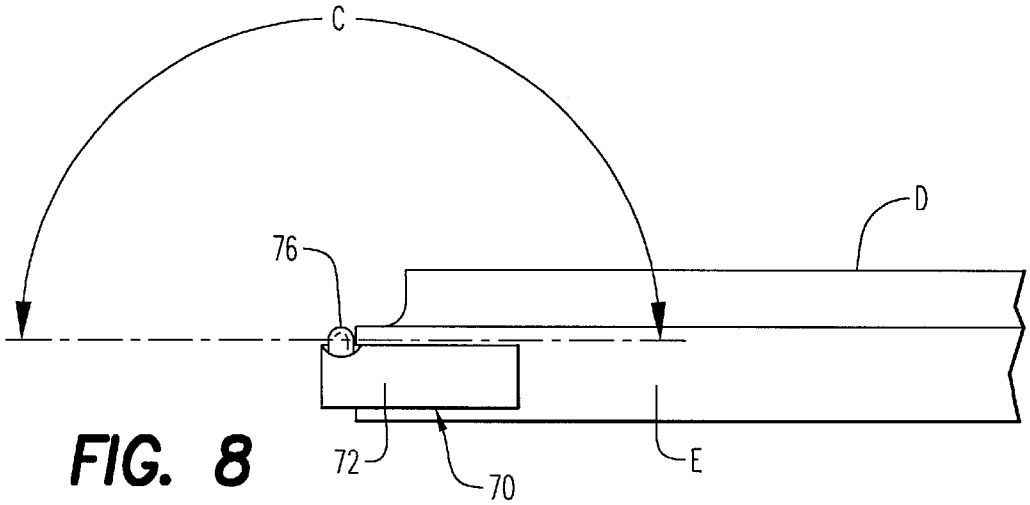
FIG. 8

APPLIANCE WARNING LIGHT DEVICE

BACKGROUND OF THE INVENTION

Scope of Invention

This invention relates generally to kitchen appliances having an openable front door, and more particularly to a viewable hazard warning device advising persons standing and working nearby the kitchen appliance that the front door is open and represents an injury inducing obstruction.

PRIOR ART

Kitchen appliances such as dishwashers and ovens have front doors which are openable by a pivotally downward and outward movement so that the open front door comes to rest in a generally horizontal orientation above the floor. The typical height of these open front doors is in the vicinity of the shin or lower leg of a typical adult person, e.g. in the range of 8" to 12" in height.

When these front doors are in the open position and being as low in relation to the floor as they typically are, a person working in the kitchen about the appliances either loading or unloading food from an oven or dishes from a dishwasher, can easily lose track or awareness of such open front doors. In these circumstances, the likelihood of running a lower leg or shin into or hitting one of the margins of the front door is greatly increased.

Applicant is a medical doctor specializing in dermatological care and routinely treats patients which have injured a shin or lower leg having inadvertently struck the open front door of a dishwasher or oven. More typically, dishwasher-related injuries are involved because the front door of a typical dishwasher is somewhat lower to the floor than the front door of a typical oven.

Applicant has taken an informal poll of approximately 100 patients which have visited his office for treatment. Of those 100 patients, approximately half have sustained leg trauma of which about 45% have incurred a serious leg injury causing skin damage or bruising and/or of sufficient severity to require professional medical attention. One such patient developed cutaneous cancer within two weeks of incurring such an injury which required surgery for removal of the cancerous tissue and an extended period of follow-up care and healing.

There appears to be no significant prior art which has, in any way, addressed this safety issue regarding open front doors of kitchen appliances such as dishwashers and ovens. An appliance door alarm apparatus invented by Thompson and disclosed in U.S. Pat. No. 4,894,643 teaches an audible or visual alarm which is actuated upon leaving the front door to the appliance open longer than a preselected time period. In U.S. Pat. No. 5,151,884, Griffith teaches a control system for an appliance indicator light for timing the amount of time the appliance front door is open after completion of the operational cycle of the appliance.

Heretofore, no patented or unpatented devices known to applicant address the issue of trying to avoid lower leg and shin injury caused by impact with the open front door of a kitchen appliance. The present invention provides such a device both in aftermarket and original manufacture form, which gives persons standing and moving about the kitchen in the vicinity of an open door of an appliance a visual cue of the potential hazard of accidental impact with the open front door.

BRIEF SUMMARY OF THE INVENTION

This invention is directed to a warning light device attachable to, or as a permanent part of, a front door of an automatic dishwasher or oven, the front door being openable to a generally horizontal very low position above the floor. In one embodiment, the device includes a housing attachable to a surface of the front door. A warning light mounted on the housing receives electric power from a miniature storage battery mounted within the housing. An angle-sensitive switch mounted in the housing is operably interconnected between the warning light and the storage battery. The switch is open and the warning light off when the front door is closed, while the switch is closed and the warning light on when the front door is open. The warning light, when on, is sufficiently visible to warn or alert a person nearby the dishwasher that the front door is open and to be avoided. This invention may also be embodied in such appliances at time of manufacture.

It is therefore an object of this invention to provide a visible hazard warning device which emits light from a surface of an appliance or its open front door to advise persons on foot working in the vicinity of the appliance that the front door is open and represents an accident hazard to lower legs.

It is another object of this invention to provide a warning light device attachable to the openable front door of a kitchen appliance such as a dishwasher or oven which is activated upon opening of the front door to provide a visual cue to those working and moving about in the vicinity of the appliance that the front door is open and represents an injury hazard to shins and lower legs.

It is still another object of this invention to provide a visual cue to those working and moving about on foot in the vicinity of a kitchen appliance when the front door of the appliance is in an open position well below normal eye level of those persons which otherwise might be potentially injured by impact of the lower leg with a side or end margin of the open front door.

It is yet another object to provide the above invention in either appliances with openable front doors at the time of manufacture or as an aftermarket device attachable to an appropriate surface of the existing appliance.

In accordance with these and other objects which will become apparent hereinafter, the instant invention will now be described with reference to the accompanying drawings.

BRIEF DESCRIPTION OF THE DRAWINGS

FIG. 7 is a top plan view of a portion of another embodiment attached to an open front door of a dishwasher.

FIG. 8 is a front elevation view of FIG. 7.

DETAILED DESCRIPTION OF THE INVENTION

Figure 1:
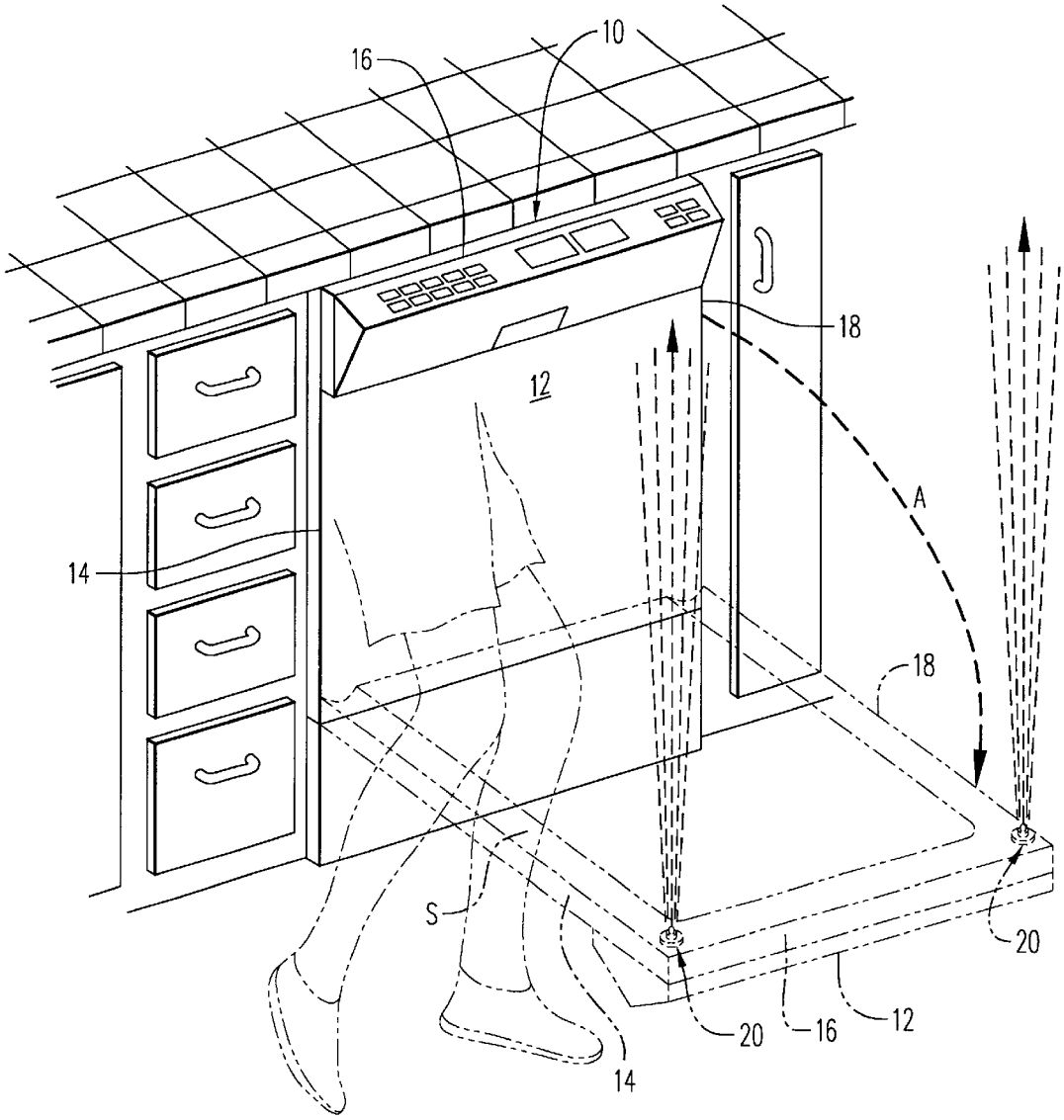
FIG. 1 is a perspective view of one embodiment of the invention in the form of an add-on to a preexisting kitchen dishwasher.
Figure 3:
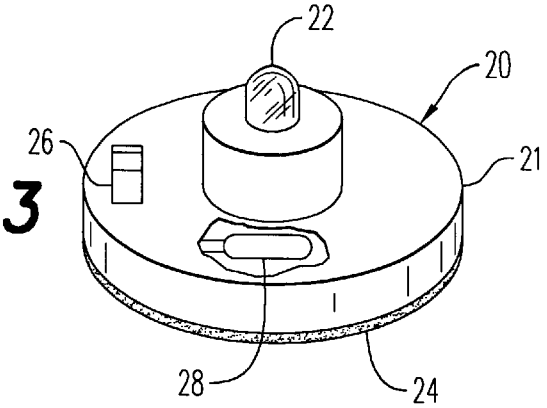
FIG. 3 is a perspective view of the light warning device shown in FIG. 1.

Referring now to the drawings and firstly to FIGS. 1 and 3, one embodiment of the invention is there shown generally at numeral 20 in conjunction with a kitchen dishwasher 10. The dishwasher 10 includes a front door 12 which is pivotally movable in the direction of arrow A from the closed upright position shown in solid lines to the open horizontal position shown in phantom.

When the front door 12 is open as shown in phantom in FIG. 1, each of the side margins 14 and 18 and end or top margin 16 are positioned at a height above the floor equal to about the center of the shin or lower leg of an adult person shown in phantom working in the vicinity of the dishwasher 10. Accidental impact as e.g. at S between the shin of the person and one margin, e.g. 14 of the front door 12, is very likely to occur. These accidental injuries occur primarily because the front door 12 is very low to the normal field of vision of a person working in a kitchen and therefore random impact between the lower leg or shin and one of the margins of the front door 12 is very likely to occur.

Applicant, as a physician and surgeon, has examined, treated and taken medical histories for years of patients who had such common lower leg and shin skin wounds and injuries. The injury to the leg by accidental impact of the open front door of the dishwasher 10 or oven appliance, results in skin tears and abrasions which heal very slowly and frequently necessitate medical/surgical attention. Follow-up visits, prescriptions for infection and occasionally surgical treatment typically follow. Moreover, if the patient is older or diabetic, surgery and extensive follow-up treatment are also required.

In this embodiment of the invention shown in FIGS. 1 and 3, a warning light device 20 is attached as by double-sided adhesive tape to the distal corners of an inner surface of the front door 12. Each of these devices 20 include a "super strobe" LED 22 having a built-in circuit board and which is operably mounted in, and upwardly aimed from, a molded plastic housing 21 having an adhesive surface 24 on the bottom thereof. Two 1.5-volt miniature batteries in series (not shown) are positioned within the housing 21 and are operably connected between the LED 22 and a mercury switch 28 which operably connects the storage battery (not shown) with the LED 22 when the device 20 is in the horizontal position shown in FIG. 1. When the front door 12 is in the closed upright position shown in solid lines in FIG. 1, the mercury switch 28 interrupts electrical power to the LED 22. A master switch 26 is provided to permanently interrupt power delivery to the LED 22.

As seen in FIG. 1, the LED 22 emits a strong, preferably pulsed stream of light upwardly in the direction of the arrows from each distal comer of the open front door 12 shown in phantom. In the form of a strobe or pulsating light beam, the person shown in phantom is much more aware of the fact that the front door 12 is open and the approximate position of the distal corners and associated side margins 14 and 18 and end or upper margin 16 so as to automatically avoid contact and injury between a lower leg and shin and the open front door 12.

Figure 2:
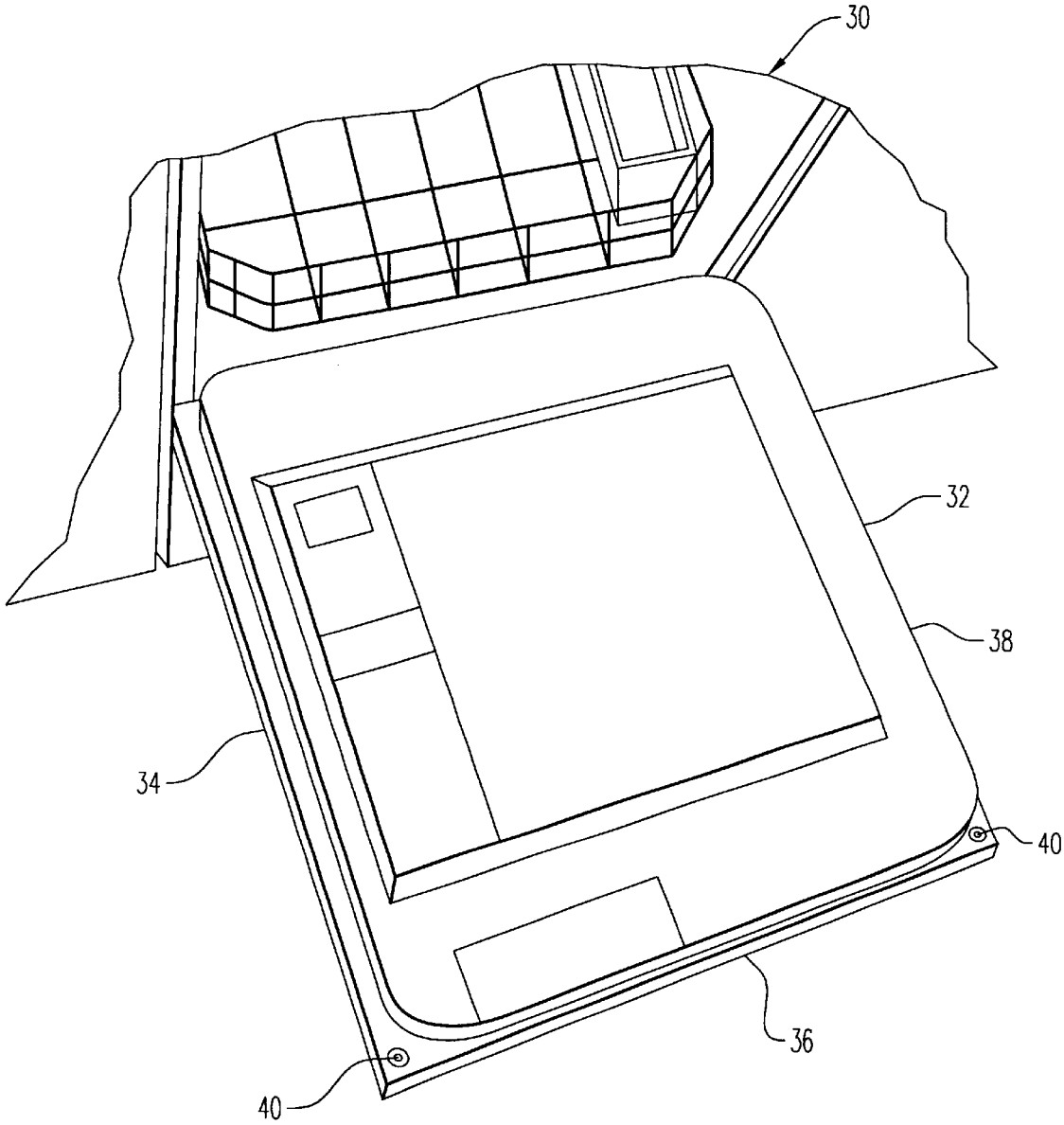
FIG. 2 is a perspective view of a front door of a dishwasher in its open position and incorporating another embodiment of the invention.
Figure 4:
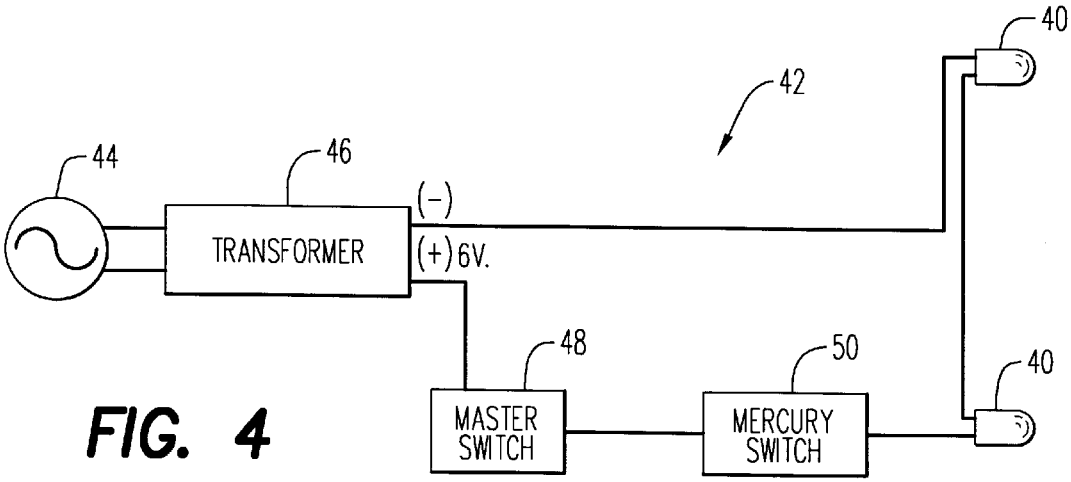
FIG. 4 is a simple electrical schematic view of the invention of FIG. 2.

Referring now to FIGS. 2 and 4, another embodiment of the invention is there shown at numeral 30 and includes a dishwasher 30 with its front door 36 shown in the open horizontal position in FIG. 2. In this embodiment 30, two LEDs 40 are permanently attached to the distal corners of the front door 36 and are focused upwardly as previously described in FIG. 1. These LEDs 40 are also of a "super strobe" type which emit a pulsating light for enhanced attraction of the attention of persons moving about in the kitchen area. As seen in FIG. 4, the warning light device shown generally at 42 includes a mercury switch 50 operably connected between a master switch 48 and the LEDs 40. A transformer 46 is required to reduce the voltage and a.c. current being received from a household supply source 44 for the dishwasher 30 down to 6 volt. The master switch 48 will switch off power to the mercury switch 50 and thus render the device 42 inoperative.

Figure 5:
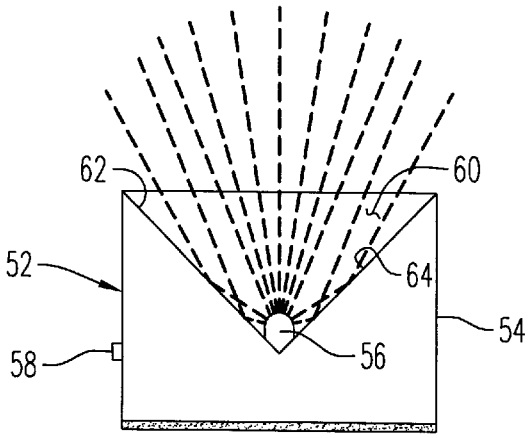
FIG. 5 is a side elevation view of another embodiment of the invention.
Figure 6:
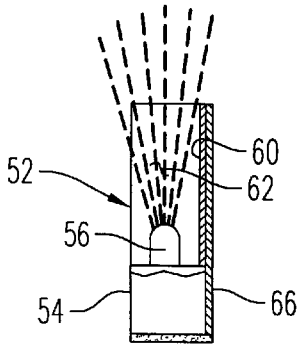
FIG. 6 is an end partial section view of FIG. 5.

Referring further to FIG. 5, another alternate embodiment of the attachable form of the device is shown generally at numeral 52 and includes a molded plastic housing 54 which supports an LED 56 of the "super strobe" type positioned at the apex of two v-shaped flat mirrored surfaces 62 and 64. These mirrored surfaces 62 and 64 are divergent at approximately 90° one to another so that the light rays emitting from the LED 56 become more focused as shown and thus produce an even more intensive and easily observable visual cue that the front door of the appliance is in an open and hazardous position. Double-sided adhesive attaching tape at 66 provides an orthogonal mounting surface which facilitates easy attachment to the inner surface of the open front door previously described.

In all instances where the invention is installed onto a surface of the front door of the appliance which will become exposed either to water and/or heat, appropriate design selection renders the warning light device suitably protected from such environments. Although it is preferred that the warning light device be attached to the front door and activated by a position sensing component such as a mercury switch, it is also envisioned that a spring-biased shut-off switch may also be utilized so that, as soon as the front door begins to be opened, the warning light device is activated.

Referring lastly to FIGS. 7 and 8, another embodiment of the invention is shown generally at numeral 70 which includes a thin flat housing 72 formed of molded plastic and attachable by double-sided tape at 74 to a top surface E of a front door D shown in an open position. The previously described components including a mercury position sensing switch and a source of battery power are not shown but are positioned within housing 72.

A strobe-type high intensity LED 76 is operably mounted within housing 72 and extends from an aperture formed within one corner of the housing 72 as shown such that light will radiate through an arch B of approximately 270° as shown in FIG. 7 and through arc C of approximately 180° as seen in FIG. 8.

To insure maximum light-emitting coverage from the LED 76, a thickness of the housing 72 is minimized to be in the range of approximately ¼" higher than surface E when the front door D is in a closed position and extends laterally beyond side surface F a variable distance determined upon installation of the device 70 so as to clear cabinetry adjacent to the dishwasher itself.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A warning light device attachable to a front door of an automatic dishwasher, the front door being openable to a generally horizontal position above a support surface of the dishwasher, said device comprising:

a housing attachable to a surface of the front door;

a warning light mounted on said housing and a miniature storage battery mounted within said housing;

an angle-sensitive switch mounted in said housing and operably interconnected between said warning light and said storage battery, said switch being open and said warning light off when the front door is closed, said switch being closed and said warning light on when the front door is open;

said warning light, when on, being sufficiently visible to warn or alert a person nearby the dishwasher that the front door is open and to be avoided.

2. A warning light device as set forth in claim 1, wherein:

said housing is sized for attachment to a distal corner inner surface of the front door with said warning light being upwardly aimed for enhanced visibility when the front door is open.

3. A warning light device as set forth in claim 1, wherein:

said housing includes flat opposing reflective surfaces which extend divergently from said warning light for visually enhancing and focusing light emitting from said warning light.

4. In combination, dishwasher and warning light device positioned on a surface of a front door of said dishwasher, said front door openable during loading and emptying of said dishwasher to a generally horizontal position at a predetermined height above the floor, said warning light device comprising:

a warning light attached to a surface of the front door;

a front door angle-sensitive switch operably interconnected between said warning light and a power source, said switch being open and said warning light off when the front door is closed, said switch being closed and said warning light on when the front door is open;

said warning light, when on, being sufficiently visible to serve as a visible warning to a person near to the dishwasher of a potential for leg injury due to impact with a margin of the open front door.

5. A warning light device as set forth in claim 4, wherein:

said warning light is attached to a distal corner of an inner surface of said front door and aimed upwardly for enhanced visibility when said front door is open.

6. A method of warning or alerting a person standing and moving on a floor adjacent to a dishwasher that a front door of said dishwasher is open in a generally horizontal position above the floor representing a leg impact hazard, comprising:

attaching a warning light device to a surface of said dishwasher, said warning light device including a warning light and a front door angle-sensitive switch operably interconnecting said warning light and an electric power source of said dishwasher, said switch being open and said warning light off when said front door is closed, said switch being closed and said warning light on when said front door is open;

said warning light, when on, being sufficiently visible on the front door to serve as a visible warning to a person near to the dishwasher of a potential for leg injury due to impact with a margin of the open front door.

7. A method as set forth in claim 6, wherein:

said device is attached to a distal corner inner surface of said front door and upwardly aimed for enhanced visibility when said front door is open.

8. An appliance warning light device attachable to a front door of an appliance, the front door being openable to a generally horizontal position above a support surface of the appliance, said device comprising:

a housing attachable to a surface of the front door;

a warning light mounted on said housing and a miniature storage battery mounted within said housing;

an angle-sensitive switch mounted in said housing and operably interconnected between said warning light and said storage battery, said switch being open and said warning light off when the front door is closed, said switch being closed and said warning light on when the front door is open;

said warning light, when on, being sufficiently visible to warn or alert a person nearby the appliance that the front door is open and to be avoided.

* * * * *